US006779207B2

(12) United States Patent
Ekeroth

(10) Patent No.: US 6,779,207 B2
(45) Date of Patent: Aug. 24, 2004

(54) RECESSED SHOWER RECEPTACLE

(75) Inventor: Vagn Ekeroth, Gustafsberg (SE)

(73) Assignee: Scandvik, Inc., Vero Beach, FL (US)

( * ) Notice: Subject to any disclaimer, the term of this patent is extended or adjusted under 35 U.S.C. 154(b) by 0 days.

(21) Appl. No.: 10/357,261

(22) Filed: Feb. 3, 2003

(65) Prior Publication Data

US 2003/0172454 A1 Sep. 18, 2003

Related U.S. Application Data

(60) Provisional application No. 60/354,183, filed on Feb. 4, 2002.

(51) Int. Cl.[7] ..... E03C 1/042

(52) U.S. Cl. ..... 4/695; 4/605; 4/615; 4/570; 4/567

(58) Field of Search ..... 4/695, 605, 615, 4/570, 567, 661, 616

(56) References Cited

U.S. PATENT DOCUMENTS 3,847,175 A * 11/1974 Anderson ..... 137/360
4,742,585 A 5/1988 Logsdon ..... 4/661
5,476,183 A 12/1995 Harpenau ..... 220/3.3
5,704,080 A * 1/1998 Kuhne ..... 4/605
6,237,167 B1 * 5/2001 Hunden ..... 4/567
6,289,529 B1 * 9/2001 Harvey ..... 4/605
6,594,832 B2 * 7/2003 Yang ..... 4/605

OTHER PUBLICATIONS

Vuova Rade spa, Divisione Nautica, 2003 catalog, p. 95.

* cited by examiner

*Primary Examiner*—Henry Bennett
*Assistant Examiner*—Azy Kokabi
(74) *Attorney, Agent, or Firm*—McAndrews, Held & Malloy, Ltd.

(57) ABSTRACT

A receptacle for a shower head capable of being mounted in different orientation and on surfaces inclined at different angles. The receptacle comprises a generally cylindrical body with an upper mounting flange and a lower wall with an opening for receiving the shower head. The cylindrical body has multiple openings to accommodate the shower head during different orientations of the receptacle. A receptacle cover is pivotally attached to the receptacle flange.

20 Claims, 3 Drawing Sheets

RECESSED SHOWER RECEPTACLE

CROSS-REFERENCE TO RELATED APPLICATIONS

Priority is claimed from provisional application U.S. Serial No. 60/354,183, filed Feb. 4, 2002, now pending. The entire specification and all the claims of the provisional application referred to above are hereby incorporated by reference to provide continuity of disclosure.

STATEMENT REGARDING FEDERALLY SPONSORED RESEARCH OR DEVELOPMENT

Not applicable.

FIELD OF THE INVENTION

The present invention relates to a marine or other recreational vehicle receptacle for receiving and storing a marine shower. The marine shower may or may not accommodate a hot-cold water mixing valve as required by the consumer.

While the invention has multiple uses readily apparent to those skilled in the art it will be described primarily for use in connection with the marine industry.

BACKGROUND OF THE INVENTION

Marine showers are most often mounted in the transom of a boat or in the cockpit coaming of a boat and in modern day boat designs these transoms and coamings comprise a multitude of surfaces with orientations from vertical to horizontal and therebetween. These orientations require different shower head receptacle designs and when a mixing valve is required a still further design is needed. Thus multiple items must be kept in inventory in order to accommodate all requirements.

A shower receptacle designed for a vertical surface will not be useful for a horizontal surface and a receptacle adapted for a straight shower handle will not accommodate a Euro-style handle with a projecting on-off lever. When a hot-cold water mixing valve is desired a further receptacle is needed to accommodate the valve. Some prior art designs feature the shower wand and hot and cold water valves in one box but this requires a large opening to be cut in the boat transom with its attendant disadvantages.

The disadvantages and limitations of the prior art devices are obviated by the present invention.

An object of the present invention is to provide a shower head receptacle adapted to be mounted on surfaces having different angles of orientation.

A further object of the present invention is to provide a shower head housing or receptacle for receiving either a straight or Euro-style shower wand or handle.

A still further object of the present invention is to provide a receptacle with a lid which is relatively easy to manufacture.

Another object of the present invention is to provide a receptacle which can accommodate various shower heads or wands as well as a hot and cold water mixing valve as the case may be.

Another object of the invention is to provide a receptacle for a shower head and a receptacle for a mixing valve in side by side relation with a single cover for both receptacles.

Other objects, advantages and features of the present invention will become apparent to those skilled in the art from the following detailed description which with referencess to the accompanying drawings discloses a preferred embodiment of the invention.

BRIEF DESCRIPTION OF THE DRAWINGS

Referring to the drawings which form part of this disclosure.

DETAILED DESCRIPTION OF THE DRAWING

Figure 1:
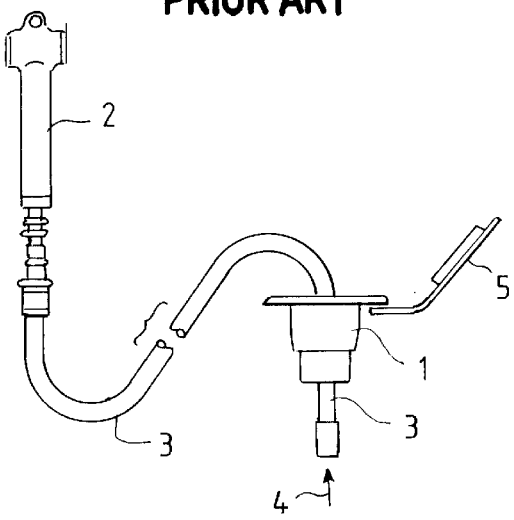
FIG. 1 PRIOR ART
FIG. 1 is a somewhat schematic representation of a horizontally mounted prior art shower assembly.

FIG. 1 shows a prior art horizontally mounted shower head housing 1 with a shower wand 2 connected to a water hose 3 at one end. A source 4 of water under pressure is connected to the other end of the hose 3. The housing 1 has a cover 5. In this prior art device the water hose 3 extends vertically through the housing 1 and the hose can be draped vertically downwardly when the wand 2 is seated in the housing 1. This housing 1 is designed for a straight shower handle 2 and will not accept a Euro-style handle with an on-off lever as will be explained in connection with FIG. 5. Additionally this housing 1 does not have any room to accommodate a mixing valve for mixing hot and cold water to the desired temperature. This will require a separate receptacle or housing as shown in FIG. 3 and FIG. 4.

Figure 2:
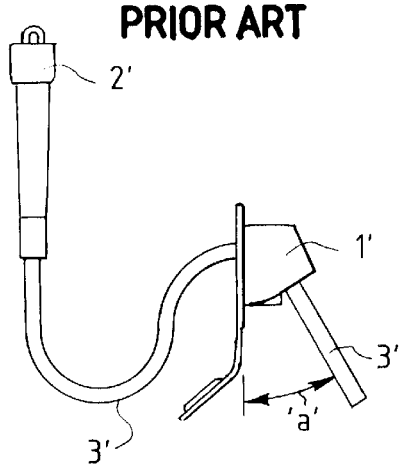
FIG. 2 PRIOR ART
FIG. 2 is a somewhat schematic representation of a vertically mounted prior art shower assembly.
Figure 3:
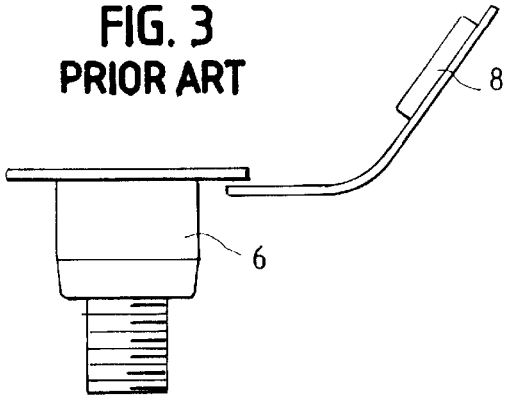
FIG. 3 PRIOR ART
FIG. 3 is a somewhat schematic representation of a mixing valve assembly of the prior art.
Figure 4:
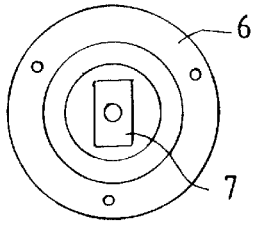
FIG. 4 PRIOR ART
FIG. 4 is a plan view of the structure shown in FIG. 3.

FIG. 3 shows a prior art housing 6 for a mixing valve 7. Housing 6 has a cover 8 and can be mounted in close proximity to the housings of FIGS. 1 and 2.

FIG. 2 shows the prior art housing 1 of FIG. 1 mounted on a vertical surface. The wand 2' has a water hose 3' attached to it. Note that the hose 3' and the wand 2' must be inserted into the housing 1' at an angle "a". For this vertical mounting it is still necessary to dress or drape the hose 3' downwardly at an angle "a" in order to prevent the hose from coming out of the receptacle when the boat is underway. The opening in the receptacle 1' through which the hose 3' exits must also be at an angle "a" to the vertical. The design of the housing 1' is of necessity different from the housing 1 of FIG. 1 and the housing 6 of FIG. 3.

Figure 5:
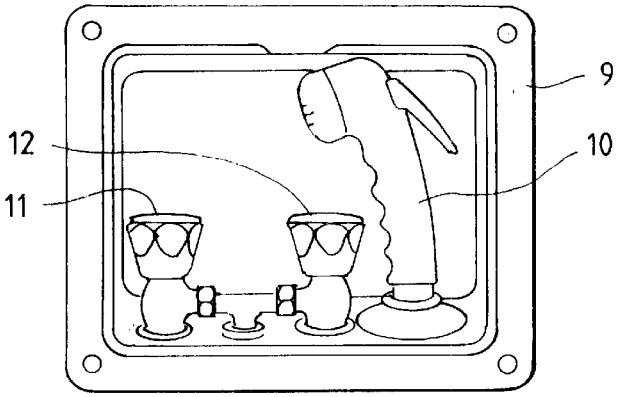
FIG. 5 PRIOR ART
FIG. 5 is a somewhat schematic representation of a prior art shower box with a Euro-style shower wand and mixing valves.

To accommodate the shower wand and the mixing valve under one lid as shown in FIG. 5 a large unit or housing 9 is required. This unit will accommodate a Euro-style wand 10 together with a hot and cold water valve 11 and 12 respectively. This unit, however, requires a large opening to be cut in the boat transom or other mounting surface.

Thus from the above description of the prior art it is readily apparent that a distributor must inventory a large number of devices in order to accommodate the different needs of a boater or user of other recreational vehicles to which showers are often added as standard or optional equipment.

In the above described prior art example at least four (4) different housings 1, 1', 6 and 9 must be inventoried.

Figure 6:
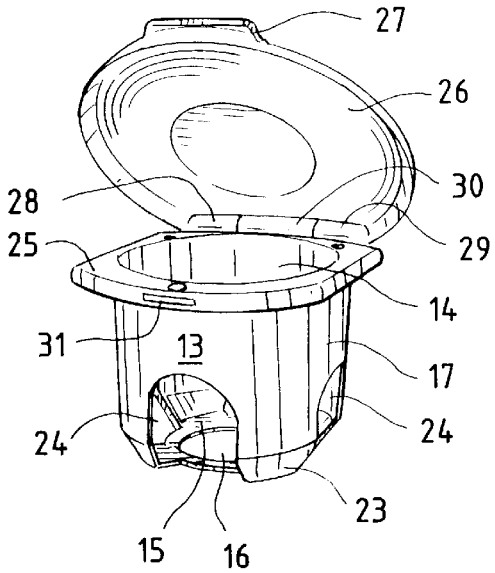
FIG. 6 is a perspective view of a shower head housing in accordance with the present invention and having its lid pivoted to an open position.
Figure 8:
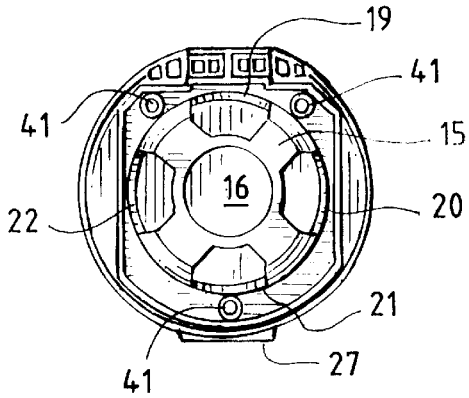
FIG. 8 shows a bottom view of the shower head housing of FIG. 6.

FIG. 6 shows a perspective view of the receptacle 13 of the present invention. The receptacle 13 has a opening or aperture 14, a bottom wall 15 with an opening or aperture 16 and four side walls each forming part of a cylinder 17. The sidewalls are shown in FIG. 8 as walls 19, 20, 21 and 22. The cylinder or shell 17 has a slight inwardly tapered portion 23 which connects the cylinder 17 to the bottom wall 15. Each of the wall portions 19–22 has an opening 24 which extends along each side wall and into the bottom wall 15 but stops short of the bottom opening 16. The openings 24 provide space for the operators fingers to retrieve the shower head. The upper portion of the cylinder 17 has a flange 25 integral with and surrounding the upper portion of the cylinder 17.

The receptacle 13 has a generally circular lid 26 with a lip portion 27 and hinge lugs 28 and 29. The cylinder 17 has a matching hinge lug 30 so that together with the lugs 28 and 29 on the lid or cover 26 a hinge is provided for the lid or cover 26. An appropriate pin is inserted through the lugs 28, 29 and 30 so that the lid 26 can be pivoted to an open or closed position. The cylinder 17 has a protrusion 31 attached to the flange 25 so that the lip 27 can be pushed over and receives the protrusion 31 to afford firm snap fit closure of the cover 26. The protrusion 31 can alternatively be in the form of a cavity and a protrusion may be provided on the lid. Various locking mechanisms may be provided and these are well known to those skilled in the art. The lid 26 fits over the flange 25 of the receptacle 13 so that when the lid 26 is closed only the lid remains in view. The lid 26 fits flush against the mounting surface 32 as shown in FIG. 7 so that no sharp corners protrude from the surface 27 with obvious advantages.

Figure 7:
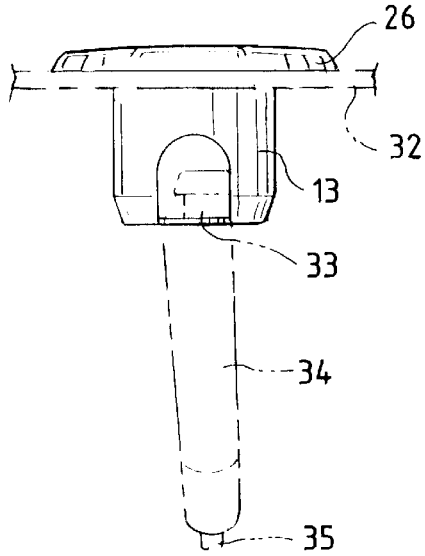
FIG. 7 shows the shower head housing of FIG. 6 mounted horizontally with a straight shower wand.

FIG. 7 shows a standard shower head 33 resting in receptacle 13 with the lid 26 closed. This arrangement shows a horizontal mounting for a standard straight shower handle 34 with the hose 35 draped downwardly.

Figure 9:
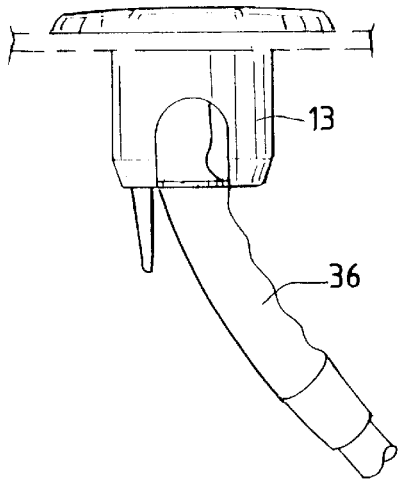
FIG. 9 shows the shower head housing of FIG. 7 with a Euro-style shower wand mounted horizontally.

FIG. 9 shows a Euro-style shower 36 in a horizontally mounted receptacle 13. In this arrangement the handle 36 extends through the bottom opening 16 of the receptacle 13 while the on-off lever 37 extends through an opening in one of the sidewalls.

Figure 10:
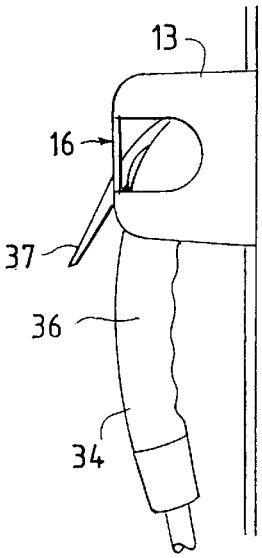
FIG. 10 shows the shower head housing of FIG. 6 with a Euro-style shower wand mounted vertically.

FIG. 10 shows the same Euro-style shower 36 in a vertically mounted receptacle 13. In this case the shower handle 34 extends downwardly through the downward facing wall of the receptacle 13 while the on-off lever 37 extends through the bottom opening 16.

Figure 11:
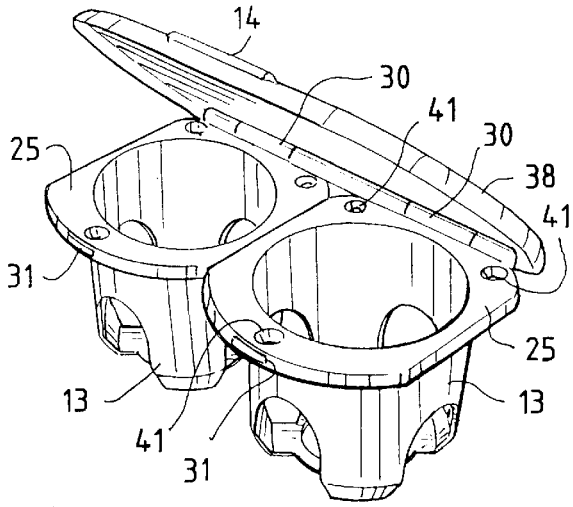
FIG. 11 shows a perspective view of two shower head housings of FIG. 6 mounted side by side and having a single lid pivoted to an open position.

FIG. 11 shows two receptacles 13 in side by side relationship. The receptacles 13 have a single lid 38 which covers both receptacles 13.

Figure 12:
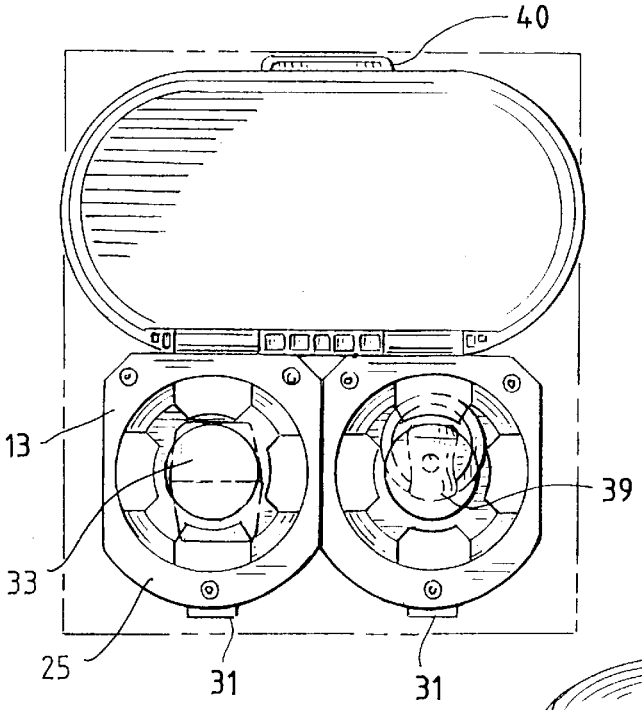
FIG. 12 is a plan view of two shower head housings of FIG. 11 carrying a shower wand in one and a mixing valve in the other and the single lid fully opened.

FIG. 12 shows a plan view of the receptacles 13 of FIG. 11 with the lid 38 fully opened. As shown in FIG. 11 the receptacle 13 on the left contains a standard shower head 33 while the receptacle 13 on the right shows a mixing valve 39. A protrusion 40 serves to aid in lifting the cover on lid 38 and pull it away from the flanges 25 which have protrusions 31 as previously described.

Figure 13:
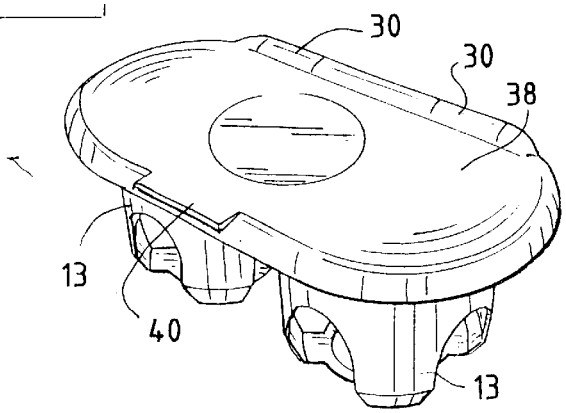
FIG. 13 is a perspective view of the structure of FIG. 11 with the single lid closed.

FIG. 13 shows the receptacles 13 with the lid 38 closed. The lug 30 as shown in FIG. 6 is the same lug as shown in FIGS. 11, 12, and 13 and is in the same location on the receptacle 13 so that no changes have to be made to the receptacles 13 when mounted in side by side relationship and utilizing a single cover.

It will be appreciated that the mounting of one or two of the receptacles 13 in the transom or coaming of a boat or a wall of another type of vehicle only requires the cutting of one or two circular openings to accommodate the cylinder 17 of the receptacle 13. This can be easily accomplished with a hole saw and does not require any fitting after the hole has been cut. This saves installation time and expense and insures accuracy. Three simple screws through openings 41 are all that is needed to secure the receptacle. This is in sharp contrast to the effort required to accommodate the shower box 9 of FIG. 5. This box requires the cutting of a rectangular opening with a saw blade the edges of which are almost impossible to keep straight and often requires filing to make the shower box 9 fit in the rectangular opening.

The use of multiple openings 24 in the sidewalls 19–22 of the receptacle 13 provides for the possibility of having the lid 26 open upwardly or downwardly or to the left or to the right. One simply needs to decide which opening the hose will pass through. This choice is available for the single as well as the double version of the receptacle, see FIGS. 6 and 11.

While the invention has been described as including a receptacle 13 with four wall portions 19–22 some of the advantages of the invention may be obtained by using fewer than four wall portions. Similarly hinge and latch arrangements different from those described may be used while still retaining the inventions' advantages.

The device of this invention is designed to be manufactured by injection molding or thermo forming and a variety of weather resistant plastics can be used.

The invention has been described with reference to a preferred embodiment. Those skilled in the art will understand that changes and modifications can be made to the described embodiment without departing from the scope of the ivention as defined in the appended claims.

What is claimed is:

1. A receptacle for storing a marine shower comprising a first shell having a top aperture, a bottom aperture and at least first and second side apertures, and a cover attached to the shell for closing the top aperture, wherein the top aperture is sized to pass a shower head, the shell is sized to receive a shower head and the first and second side apertures are sized to receive the hose attached to the shower head.

2. The receptacle of claim 1 including a flange surrounding the top aperture of the shell.

3. The receptacle of claim 2 wherein the flange has openings for attaching the receptacle to a wall.

4. The receptacle of claim 1 including a bottom wall for accommodating said bottom aperture.

5. The receptacle of claim 1 wherein said shell has four (4) side apertures spaced 90° apart.

6. The receptacle of claim 1 further comprising a second shell mounted in close proximity to said first shell.

7. The receptacle of claim 6 wherein said first and second shells have a common cover hingedly attached to said shells.

8. A receptacle for storing a marine shower comprising at least one shell having a top aperture, a bottom aperture, at least first and second side apertures, and a cover attached to the shell for closing the top aperture, wherein the top aperture is sized to pass a shower head, the shell is sized to receive a shower head and the first and second side apertures are sized to receive the hose attached to the shower head.

9. The receptacle of claim 8 including a flange surrounding the top aperture of the shell.

10. The receptacle of claim 9, wherein said flange has a protrusion to provide for a snap fit closure for said cover.

11. The receptacle of claim 9, wherein the cover hingedly attached to the flange for closing the top aperture.

12. The receptacle of claim 9, wherein the flange has openings for attaching the receptacle to a wall.

13. The receptacle of claim 8 including a bottom wall for accommodating the bottom aperture.

14. The receptacle of claim 13, wherein the side apertures are located in the shell and extend into the bottom wall.

15. The receptacle of claim 8, wherein the shell has four (4) side apertures spaced about 90° apart.

16. A receptacle for storing a marine shower comprising a first shell having a top aperture, a bottom aperture and at least first and second side apertures, a flange surrounding the top aperture of the shell, and a cover hingedly attached to said flange for closing said top aperture, wherein the top aperture is sized to pass a shower head, the shell is sized to receive a shower head and the first and second side apertures are sized to receive the hose attached to the shower head.

17. The receptacle of claim 16 wherein said flange has a protrusion to provide for a snap fit closure for said cover.

18. A receptacle for storing a marine shower comprising at least one shell having a top aperture, a bottom aperture, at least first and second side apertures, and a bottom wall for accommodating the bottom aperture, wherein the top aperture is sized to pass a shower head, the shell is sized to receive a shower head, the first and second side apertures are sized to receive the hose attached to the shower head, and the side apertures are located in the shell and the bottom wall.

19. The receptacle of claim 18 including a flange surrounding the top aperture of the shell.

20. A receptacle for storing a marine shower comprising a first shell having a top aperture, a bottom aperture and at least first and second side apertures, and a bottom wall for accommodating said bottom aperture, wherein the top aperture is sized to pass a shower head, the shell is sized to receive a shower head and the first and second side apertures are sized to receive the hose attached to the shower head, and said side apertures are located in said shell and extend into said bottom wall.

* * * * *